US005950856A

United States Patent [19]

Cinque

[11] Patent Number: 5,950,856

[45] Date of Patent: Sep. 14, 1999

[54] PLATE AND CUP HOLDER

[76] Inventor: Richard Cinque, 7040 Avenida Encinas, Carlsbad, Calif. 92009

[21] Appl. No.: 09/060,101

[22] Filed: Apr. 14, 1998

Related U.S. Application Data

[60] Provisional application No. 60/043,602, Apr. 15, 1997.

[51] Int. Cl.[6] ..... A47G 19/00

[52] U.S. Cl. ..... 220/23.4; 220/23.86

[58] Field of Search ..... 248/309.1, 311.2; D7/396.6, 388, 610; 220/575, 23.4, 23.86, 23.83, 574

[56] References Cited

U.S. PATENT DOCUMENTS

| | | | |
|---|---|---|---|
| D. 168,327 | 12/1952 | Alper | D7/507 |
| 2,307,882 | 1/1943 | Freud et al. | 220/23.4 |
| 2,916,180 | 12/1959 | Alger | 220/23.86 |
| 4,989,742 | 2/1991 | Powell | 220/23.4 |
| 5,429,266 | 7/1995 | D'Oliveira et al. | 220/556 |
| 5,598,944 | 2/1997 | Aragona | 220/575 |
| 5,607,077 | 3/1997 | Torkelson | 220/575 |
| 5,697,512 | 12/1997 | Brickley | 220/23.8 |

*Primary Examiner*—Ramon O. Ramirez
*Assistant Examiner*—Gwendolyn Baxter
*Attorney, Agent, or Firm*—Knobbe, Martens, Olson & Bear, LLP

[57] ABSTRACT

A combination plate and cup holder formed of a rigid web having first and second ends, a recessed portion sized to receive and hold a plate in the first end, and a circular hole extending through the second end of sufficient diameter to receive and hold a cup or glass.

8 Claims, 3 Drawing Sheets

PLATE AND CUP HOLDER

RELATED APPLICATIONS

This application claims priority from U.S. Provisional Patent Application Serial No. 60/043,602, filed Apr. 15, 1997.

FIELD OF THE INVENTION

The present invention relates to a plate and cup holder suitable for use in parties to permit an individual to carry both a plate and a cup with one hand.

BACKGROUND OF THE INVENTION

Party-goers are often faced with difficulties in dealing with food and beverage. In particular, at a stand-up function, such as a buffet, in which food and beverages are served, it is awkward to try to carry both a plate and a cup. In such social functions, one often has to shake hands. Handshaking is impeded if both hands are occupied with a cup and a plate, open doors, or perform other tasks. Similarly, with a cup in one hand and a plate in another, a party-goer is hard pressed to consume the food on the plate. Doing so requires consolidating the cup and plate into one hand while eating with the other.

Many food establishments serve their customers on trays. The tray can typically hold a plate of food, utensils, and beverage. However, such conventional trays are too large or bulky for party-goers. Moreover, only a slight incline of the tray causes the drink to tip or slide, with potentially disastrous results.

Accordingly, there is a need for party-goers to carry a cup and a plate, while still having one hand free to eat or to shake hands.

SUMMARY OF THE INVENTION

In one embodiment, the present invention is a combination plate and cup holder, comprising: a rigid web having first and second ends, the first end having a circular recessed portion sized to receive and hold a plate, the second end connected to and extending beyond the recessed portion, the second end having a circular or semi-circular hole therein for receiving and holding a cup, so that by holding the web, and user can simultaneously carry both a cup and a plate. Optionally, the web has a periphery and is sufficiently rigid to support both a cup and a plate when held from any point on the periphery. The periphery preferably extends beyond a plate or a cup carried on the holder a sufficient distance to permit a user to grip the periphery and to thereby support such plate and cup.

The web may further include a portion between the first and second ends of sufficient size that it can be gripped by a user to support both a plate and a cup carried on the holder. The holder may advantageously be formed in an oval or ellipsoidal shape, to perform the holding function while minimizing its size. The holder alone is disclosed, as well as the holder in combination with a cup in the hole and a plate in the recess.

In a preferred embodiment, the web extends a uniform distance from the circular recess for at least about 180° of arc. The recessed portion includes optionally includes one or more holes therein. One preferred embodiment includes a slot through the periphery of the holder into the cup holder, to allow stemmed glasses to be carried by the holder.

Another version of the present invention is a food holder, comprising a circular plate, preferably formed of plastic or cellulosic material, and a cup holder extending from one side of the plate, the cup holder having a circular hole therein sized for receiving a cup. In one embodiment, the cup holder is formed integrally with the plate.

DETAILED DESCRIPTION OF THE INVENTION

The combination plate and cup holder of the present invention is not a tray in the conventional sense. Instead, its securely holds the cup and one or more plates and combines the two into what is almost a unitary article. The plate and cup holder of the present invention can be tilted, waved about, and otherwise handled in a manner typical of party-goers, while still retaining the cup and the plate and avoiding spilling food or drink.

Figure 1:
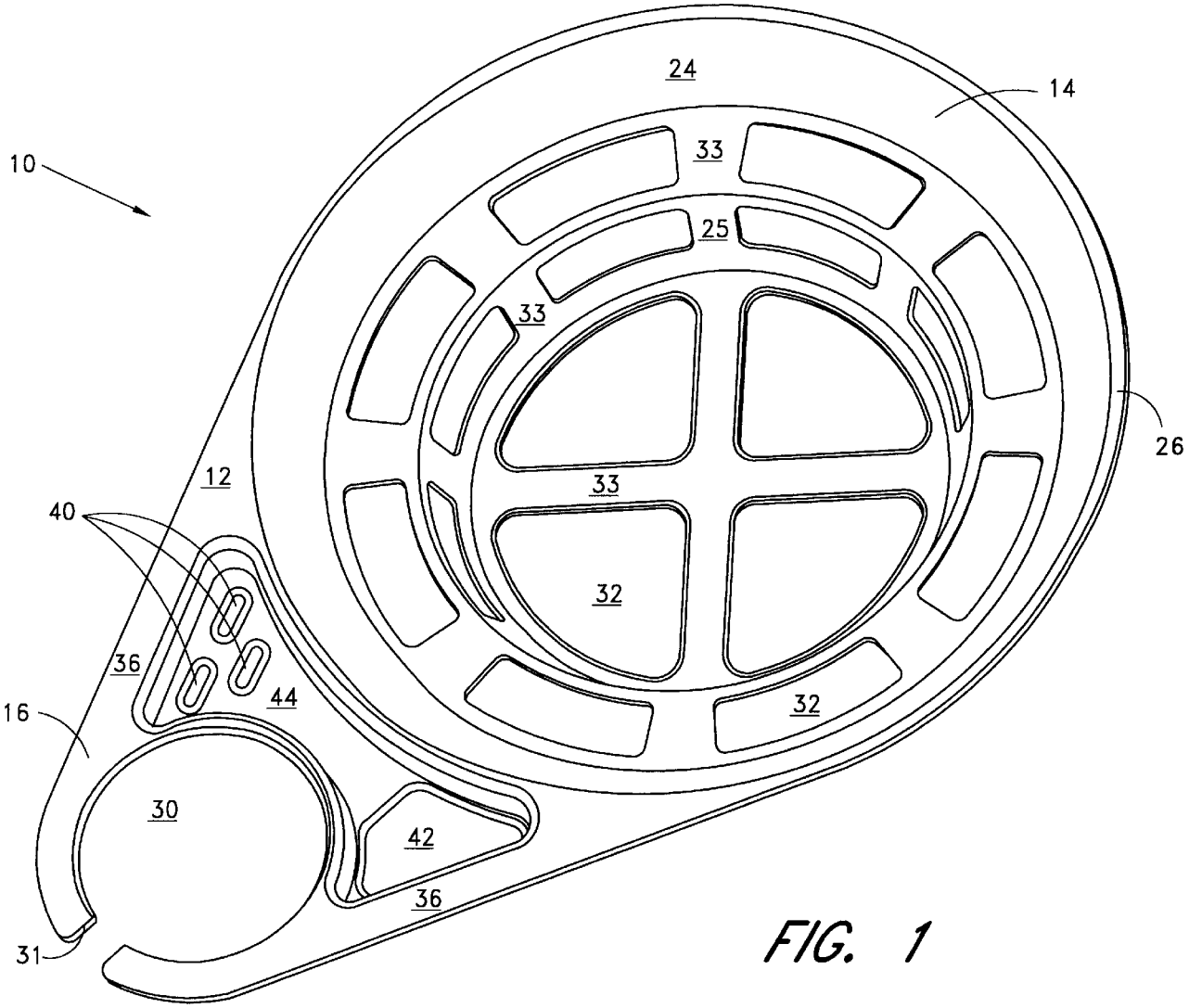
FIG. 1 is a perspective view of one plate and cup holder of the present invention.
Figure 2:
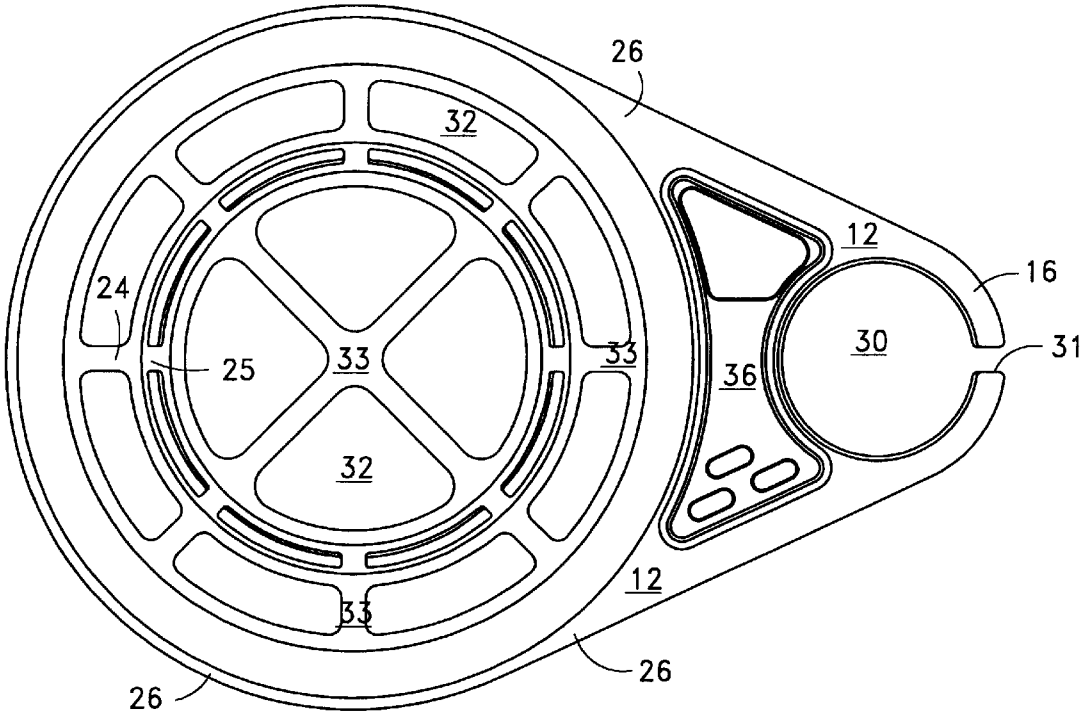
FIG. 2 is a plan view of the plate and cup holder of FIG. 1.
Figure 3:
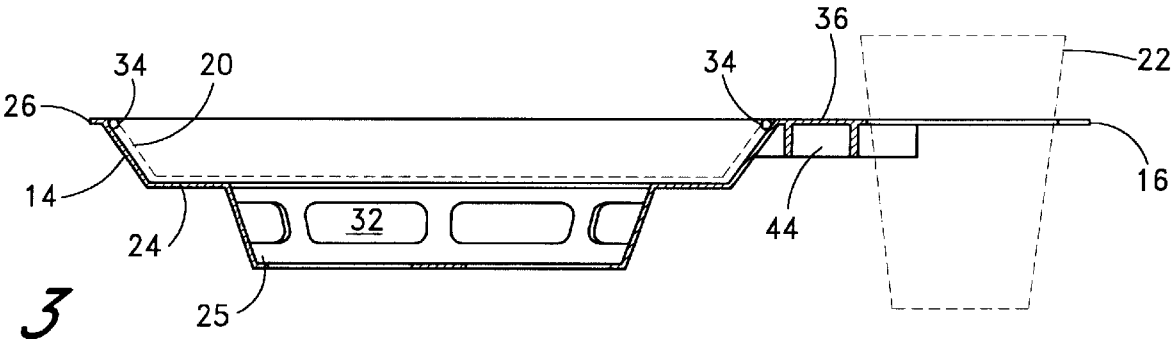
FIG. 3 is a longitudinal cross-section of the plate and cup holder of FIG. 2, taken along the line A—A.

With respect to FIGS. 1–3, the plate and cup holder 10 of the present invention comprises a web of relatively flat, rigid material. The web 12 may be formed of any suitable material, such as a plastic (e.g., thermoplastic) or an equivalent material, such as paperboard or solidified polymer resin.

The holder 10 has a relatively large first end 14 joined to a relatively smaller second end 16. The first end 14 is adapted to hold to a plate 20 (shown in phantom in FIG. 3). The second end 16 is adapted to hold a cup 22 (shown in phantom in FIG. 3).

The first end 14 of the holder 10 has a recessed portion 24 for holding the plate 20. The recessed portion 24 is preferably circular, and may be any suitable size for receiving a desired plate (e.g., 4", 5", 6", 8", 10", or the like). A second recessed portion 25 may also be provided, located concentrically within the recessed portion 24, having a smaller diameter than the recessed portion 24 and extending below the recessed portion 24, adapted for holding a smaller plate than does the recessed portion 24. In this manner, one holder 10 can be used with a variety of sizes of plates 20.

A periphery 26 may be provided surrounding the recessed portion 24. This periphery 26 preferably extends radially outwardly from the recessed portion 24, around the outside of the first end 14. It is preferably generally horizontal. The periphery 26 may advantageously be sufficient wide to permit a user to grip it and support the entire holder-plate-cup combination (e.g., 1" or 2" wide). Alternatively, it can be relatively narrow, providing structural support but not necessarily a gripping surface. In a preferred embodiment, the periphery 26 surrounds the circular recess 24 and extends outwardly a uniform distance from the circular recess 24 for a least 180° of arc.

The second end 16 of the holder 10 includes a cup holder. In a preferred embodiment, the cup holder is a hole 30 extending through the web 12 at the second end 16 of the holder 10. The hole 30 is sized appropriately so that a tapered cup (shown in phantom in FIG. 3) can sit in the hole 30. The cup 22 preferably extends down in the hole 30 at least 30% of the height of the cup 22, more preferably 40%, 50%, 60%, or 75% of the height of the cup 22. When the cup 22 extends into the hole 30 a significant portion of its height (preferably at least half of the height of the cup 22), it is relatively stable and secure. The cup 22, held in this manner, is unlikely to fall out of the hole 30, even when the holder 10 is tipped to a significant degree.

As will be appreciated from the Figures and the foregoing description, the holder 10 of the present invention is relatively compact. It holds the cup and the plate, but unlike a tray, it does not occupy additional unnecessary area. In a preferred embodiment, the holder 10 is generally oval or ellipsoid in shape. Most of the area of the holder 10 is taken up by the plate 20 and the cup 22. In a preferred embodiment, at least 60%, 70%, 80%, or even 90% of the surface area of the holder 10 is taken up by the plate 20 and the cup 22.

The hole 30 may be surrounded by the web 12 for at least 270° of arc, preferably at least 300° or 330° of arc. In FIGS. 1–3, the hole 30 is completely surrounded by the web 12, except for a slot 31 through the web 12 at the second end 16, to allow a wine glass or other stemmed glass or cup to be held in the hole 30. In that illustrated embodiment, the web 12 extends outward from the hole 30 a relatively uniform distance for at least 90° total, and can extend around the hole 30 a uniform distance through 120° or even 180° of arc.

In one embodiment of the invention, the holder 10 has openings 32 through the web 12 in the recessed portions 24 and 25. These openings 32 can serve as finger holes for holding the device or to facilitate removing a plate 20 from the recessed portion 24.

The entire holder 10 is preferably formed of web material 12 that is sufficiently rigid that the holder 10 can support a full plate 20 and cup 22 without significant bending. This can be done by selecting a sufficient thickness of web material 12, or through use of ribs 33 or other conventional reinforcing means (not shown).

In one embodiment of the invention, the plate 20 sits loosely in the recessed portion 24. In this embodiment, the curvature of the recessed portion 24 preferably conforms to the curvature of the plate 20, so as to fictionally hold the plate 20 in place even when the holder 10 is tipped to an angle of 5°, 10°, or even 20° or 30° from horizontal.

In another embodiment of the present invention, the holder 10 is provided with a plate retainer 34 extending into or over the recessed area of the recessed portion 24 in the opposite direction of the periphery 26. The plate retainer 34 may be a continuous lip extending radially inward over the recessed portion 24. Alternatively, it can be a plurality of inwardly-extending tabs. In any event, the plate retainer 34 will extend inwardly over the edge of a plate 20 to retain the plate 20 in the recessed portion 24.

In yet another embodiment of the invention, the holder 10 is provided without openings 32 in the recessed portion 24. In this embodiment, the recessed portion 24 itself defines a circular plate. Thus, this embodiment can be used without a separate plate 20 inserted in the recessed portion 24.

The first end 14 and the second end 16 of the holder 10 are joined by a neck 36. This neck 36 may, in one embodiment, be as wide as the hole 30, or even wider. When formed in this manner, the neck 36 provides a gripping area for holding the holder 10. The neck 36, in the illustrated embodiment, tapers uniformly from a point on the periphery 26 surrounding the recessed portion 24 to a point adjacent to or even midway along the hole 30, and can advantageously define a straight line between said points.

In yet another preferred embodiment, the neck 36 may be significantly narrower than the hole 30. This further facilitates the compactness of the current design.

In still another embodiment of the invention, the holder 10 is so compact that the web 12 does not extend beyond the hole 30 or the recessed portion 24 more than 30% of the diameter of the recessed portion 24, preferably not more than 20%, 15%, or 10% of the diameter of the recessed portion 24, except perhaps in the area of the neck 36 between the first end 14 and the second end 16.

In the illustrated embodiments, the neck 36 includes utensil holes 40 formed in the neck, sized such that the handle of a utensil can pass through, but not the head of the utensil. The neck 36 also preferably includes one or more napkin holes 42, into which a folded paper or cloth napkin can be inserted and frictionally held. If desired, to impart additional rigidity, the napkin hole 42 and the utensil holes 40 may be located with a recessed area 44 in the neck 36.

Figure 4:
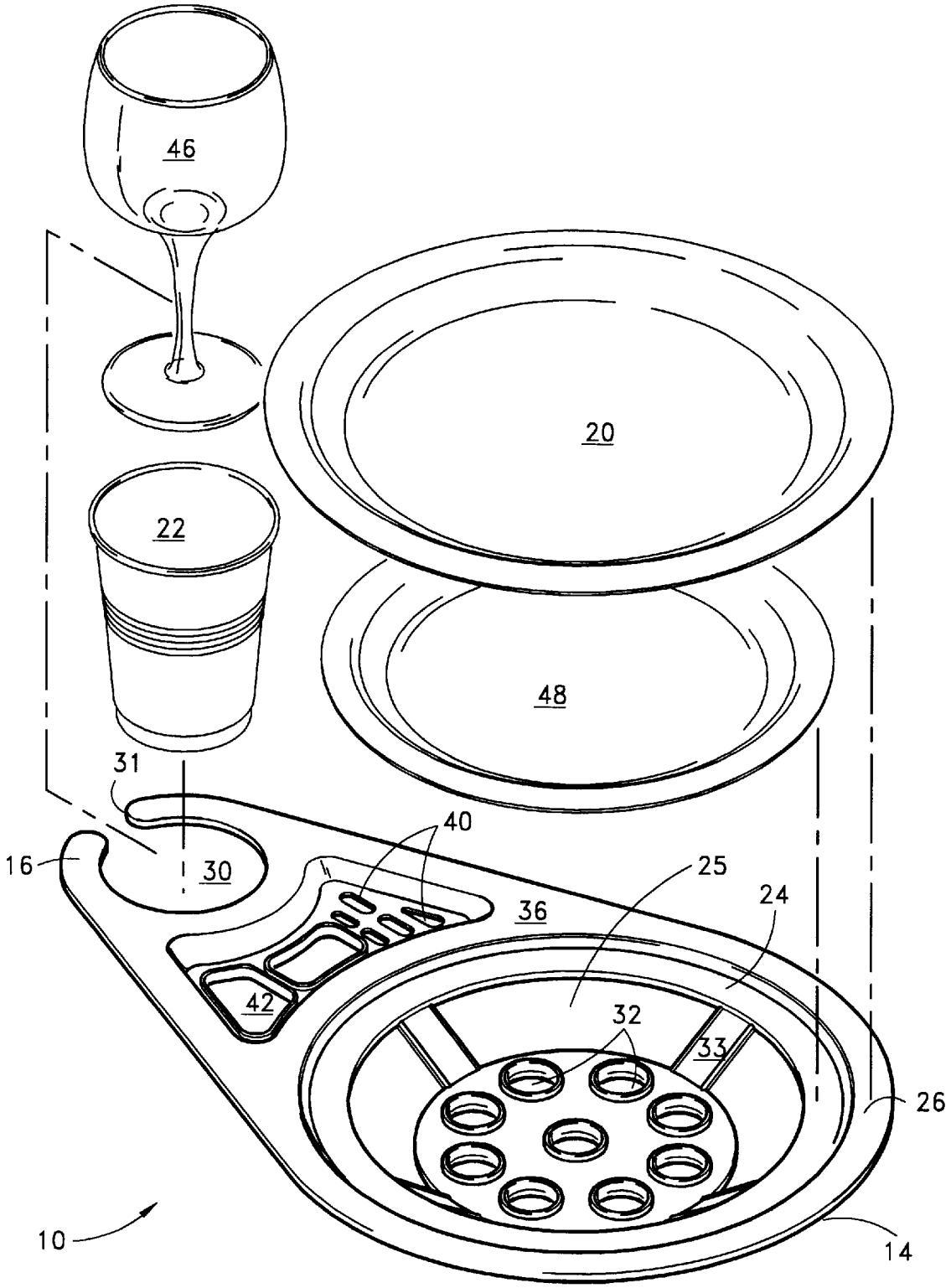
FIG. 4 is a perspective view of an alternative embodiment of a plate and cup holder of the present invention, illustrating the use of plates and cups with the holder.

FIG. 4 shows a slightly different alternative design of the holder 10, illustrating the manner in which it is used with a cup and plate. In this embodiment, the periphery 26 is sufficiently wide to provide a gripping surface. An alternative design of the openings 32 provides finger holes for holding the holder 10. It is preferred that the openings 32 are located a sufficient distance below the height of the plate 20 that insertion of the fingers can be accomplished without dislodging the plate 20. Appropriate distances could be, for example, ¾ inch, 1 inch, or 1½ inches below the plate 20.

With reference to FIG. 4, it will be appreciated that either a conventional tapered plastic or paper cup 20 can be inserted into the hole 30, or with the provision of the slot 31 in the second end 16 of the holder, a stemmed glass 46 can similarly be inserted and held in the hole 30.

The plate 20 may be inserted into and held by the recessed portion 24 Alternatively, the same holder 10 can be used to hold a smaller plate 48 in the second recessed portion 25.

Although the present invention has been described in the context of certain preferred embodiments, it will be understood that the scope of the invention is to be measured by the claims that follow, without limitation to particular preferred embodiments described herein.

What is claimed is:

1. A combination plate and cup holder, comprising:

a rigid web having first and second ends;

said first end having a first circular recessed portion adapted to be sized to receive and hold a plate having a first diameter, and a second, smaller recessed portion located concentrically within the first recessed portion for holding a plate having a second, smaller diameter, wherein the second recessed portion has a bottom, and the bottom comprises a substantially flat region having openings therethrough of sufficient diameter for insertion of a finger therethrough;

said second end connected to and extending to one side of said recessed portion, said second end having a circular hole therein for receiving and holding a tapered cup adapted to contact with sides of the cup or a stemmed glass adapted to contact with the glass above the stem, said second end further having a slot therethrough into the circular hole to permit passage of the stem of the stemmed glass, so that by holding said web, a user can simultaneously carry both the cup or the glass and the first or second plate, wherein the first or second recessed portion is adapted to rest the plate thereon.

2. The holder of claim 1, wherein the web further includes a portion between the first and second ends of sufficient size that said portion of said web can be gripped by a user to support both the plate and the cup carried on the holder.

3. The holder of claim 2, having an oval shape.

4. The holder of claim 2, wherein, when the plate or the cup is adapted to carried on said holder, said periphery extends beyond the plate or the cup a sufficient distance to permit the user to grip said periphery and to thereby support such plate and cup.

5. The holder of claim 2, wherein said periphery to adapted to extend beyond the plate or the cup carried on said holder a sufficient distance to permit a user to grip said periphery and to thereby support such plate and cup.

6. The holder of claim 1, further in combination with a cup in said hole and a plate in said first recessed portion.

7. The holder of claim 1, wherein said web extends a uniform distance from the circular recess for at least about 180°.

8. The holder of claim 1, further comprising a neck connecting said first and second ends, said neck having holes therein sized for holding a napkin, at least one utensil, or both.

* * * * *